US005421904A

United States Patent [19]

Carlson

[11] Patent Number: 5,421,904

[45] Date of Patent: Jun. 6, 1995

[54] PERPENDICULAR DRAIN PIPE CLEAN OUT NOZZLE

[76] Inventor: Gilbert B. Carlson, 4107 Fairman St., Lakewood, Calif. 90712

[21] Appl. No.: 179,759

[22] Filed: Jan. 7, 1994

Related U.S. Application Data

[63] Continuation of Ser. No. 54,854, Apr. 28, 1993, abandoned, which is a continuation-in-part of Ser. No. 860,302, Mar. 27, 1992, abandoned, which is a continuation-in-part of Ser. No. 722,594, Jun. 27, 1991, abandoned.

[51] Int. Cl.[6] ..... B08B 9/02

[52] U.S. Cl. ..... 134/22.12; 239/567; 134/167 C

[58] Field of Search ..... 239/567, DIG. 13, 548; 134/22.12, 167 C

[56] References Cited

U.S. PATENT DOCUMENTS

| | | | |
|---|---|---|---|
| 1,022,974 | 4/1912 | Sargeant . | |
| 1,888,404 | 11/1932 | Yahnka . | |
| 3,014,668 | 6/1950 | Boyd . | |
| 3,017,118 | 4/1959 | Kane . | |
| 3,018,058 | 4/1959 | Koller . | |
| 3,550,861 | 12/1968 | Teson . | |
| 3,550,864 | 12/1968 | East . | |
| 3,744,723 | 7/1973 | Davis | 234/543 |
| 3,912,173 | 10/1975 | Robichawx . | |
| 3,937,404 | 2/1976 | Johnson . | |
| 4,161,290 | 7/1979 | Hill . | |
| 4,629,128 | 12/1986 | Lawrence . | |
| 4,687,011 | 8/1987 | Masaru . | |
| 4,699,163 | 10/1987 | Baziuk . | |
| 4,700,894 | 10/1987 | Grzych . | |
| 4,705,218 | 11/1987 | Dabiels . | |
| 4,756,324 | 7/1988 | Larsonn . | |
| 4,756,480 | 7/1988 | Flah . | |
| 4,773,960 | 9/1988 | Vincelli . | |
| 4,784,325 | 11/1988 | Walker . | |
| 4,784,327 | 11/1988 | Lund . | |
| 4,784,328 | 11/1988 | Skraba . | |
| 4,819,314 | 4/1989 | Shaddock | 239/DIG. 13 X |

FOREIGN PATENT DOCUMENTS 22104 8/1915 United Kingdom .

*Primary Examiner*—Andres Kashnikow
*Assistant Examiner*—Kevin P. Weldon
*Attorney, Agent, or Firm*—Frank J. Uxa

[57] ABSTRACT

New nozzles and methods for cleaning debris from drain pipes are disclosed. In one embodiment, the present nozzle comprises a nozzle body including a peripheral sidewall having a plurality of spaced apart peripheral through holes positioned to cause fluid from the interior space defined by the nozzle body to pass through the peripheral through holes in a direction substantially perpendicular to the longitudinal axis of the nozzle body. In addition, the nozzle body preferably includes a distal end wall having at least one longitudinal through hole positioned to cause fluid from the internal space to flow through the longitudinal through hole in a direction substantially parallel to the longitudinal axis of the nozzle body.

18 Claims, 1 Drawing Sheet

PERPENDICULAR DRAIN PIPE CLEAN OUT NOZZLE

RELATED APPLICATIONS

This application is a continuation of applicable Ser. No. 08/054,854, filed Apr. 28, 1993, now abandoned, which is a continuation-in-part of application Ser. No. 07/860,302 filed Mar. 27, 1992, now abandoned, which in turn, is a continuation-in-part of application Ser. No. 07/722,594, filed Jun. 27, 1991, now abandoned. Each of these applications is incorporated in its entirety herein by reference.

BACKGROUND

1. Field of Invention

This invention relates to a nozzle for flushing out solid or semi-solid debris that clogs and prevents or inhibits the flow of waste water through right angle coupled waste water drain pipes in household, commercial and industrial applications.

BACKGROUND

2. Description of Prior Art

Heretofore, it was required to use mechanical devices, such as sewer rods, manual or power wire augers that rotate a mechanical spring material head and the like, to scrap and/or dislodge solid debris from drain pipes, for example, drain pipes which include right angle extensions such as T-joints and elbow joints. Other methods of removing solid debris from such drain pipes involve using powerful, e.g., caustic, chemicals. Such methods are often not effective to achieve the desired cleaning, are tedious and labor intensive and/or can result in harming the drain pipe to be cleaned.

It would be advantageous to provide a simplified, easy to practice, effective and safe approach to cleaning drain pipes.

SUMMARY OF THE INVENTION

New nozzles and methods, for example, using such nozzles, for cleaning debris from drain pipes have been discovered. The present invention makes use of high pressure fluid, preferably liquid, such as aqueous-based liquids, to clean out drain pipes. The present nozzle is configured to effectively clean the lateral right angle extension segment or segments of drain pipe from a longitudinally disposed drain pipe segment or conduit employing a high pressure fluid. Preferably, the nozzle is configured to clean debris from the longitudinally disposed conduit in which the nozzle is positioned. The present system, which uses high pressure fluid, such as fluid under pressure from municipal water systems, provides a simple yet very effective approach to cleaning drain pipes, in particular segments of drain pipes which are hidden and unseen, such as segments coupled by T-joints and elbow joints. The present invention is easy to practice and, because relatively mild chemical agents or even city water alone can be used as the high pressure fluid, is safe for use with a large number of drain pipe materials of construction.

In one broad aspect of the present invention, nozzles are provided which comprise a nozzle body having a longitudinal axis. This nozzle body defines an interior space adapted to be placed in fluid communication with a source of high pressure fluid. The nozzle body includes a peripheral sidewall, preferably having a circular cross-section perpendicular to the longitudinal axis of the nozzle body. This sidewall has a plurality, preferably in the range of 4 to about 10 and more preferably about 8, spaced apart peripheral through holes positioned to cause fluid from the interior space to pass through the peripheral through holes in a direction substantially perpendicular to the longitudinal axis of the nozzle body. The nozzle body also preferably includes a distal end wall having at least one longitudinal through hole positioned to cause fluid from the interior space to flow through the longitudinal through hole in a direction substantially parallel to the longitudinal axis, preferably in a direction substantially along or through the longitudinal axis.

The positioning of the peripheral through holes and the longitudinal through hole or holes are an important aspect of the present invention. The peripheral through holes are spaced apart and provide fluid flow in a direction substantially perpendicular to the longitudinal axis of the nozzle body. In this manner, with the nozzle body positioned at the juncture of a T-joint or an elbow joint, the fluid will pass directly from the peripheral through hole into the leg of the elbow or legs of the T-joint not containing the nozzle. This direct flow facilitates the cleaning effectiveness of the present nozzle. Also, the longitudinal through hole or holes provide for cleaning the longitudinal conduit in which the nozzle is placed or is being passed to reach its final position. Again, the positioning of the longitudinal through hole or holes allows for direct contact of high pressure fluid with the debris immediately in front of the nozzle as the nozzle is being passed through the longitudinal conduit.

In another broad aspect of the present invention, methods of passing high pressure fluid to at least one segment of drain pipe positioned substantially perpendicular to a conduit, for example, coupled to the conduit by a T-joint or elbow joint, are provided. Such methods comprise passing a nozzle in fluid communication with a source of high pressure fluid through the conduit, for example, a longitudinally disposed segment of drain pipe. The nozzle defines an interior space, has a longitudinal axis, includes a distal end wall and a peripheral sidewall with a plurality of spaced apart peripheral through holes positioned to cause high pressure fluid from the interior space to pass through the peripheral through holes in a direction substantially perpendicular to the longitudinal axis of the nozzle. The passing of the nozzle through the conduit is conducted so as to position the nozzle relative to at least one segment of drain pipe positioned substantially perpendicular to the longitudinal axis of the conduit so that high pressure fluid from the interior space flows directly from at least one of the peripheral through holes into the at least one segment. High pressure fluid is caused to flow from the source of high pressure fluid into the interior space, through the peripheral through holes and directly into the at least one segment. This process provides for very effective cleaning of the at least one substantially perpendicularly disposed segment of drain pipe.

These and other aspects of the present invention will become apparent in the following description of the invention, particularly when considered in conjunction with the accompanying drawings in which like parts bear like reference numerals.

DETAILED DESCRIPTION OF THE DRAWINGS

Figure 1:
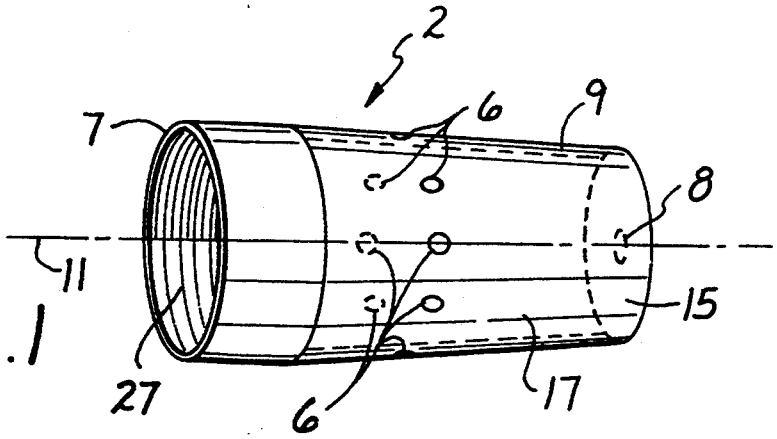
FIG. 1 is a perspective view of one embodiment of the nozzle of the present invention.
Figure 2:
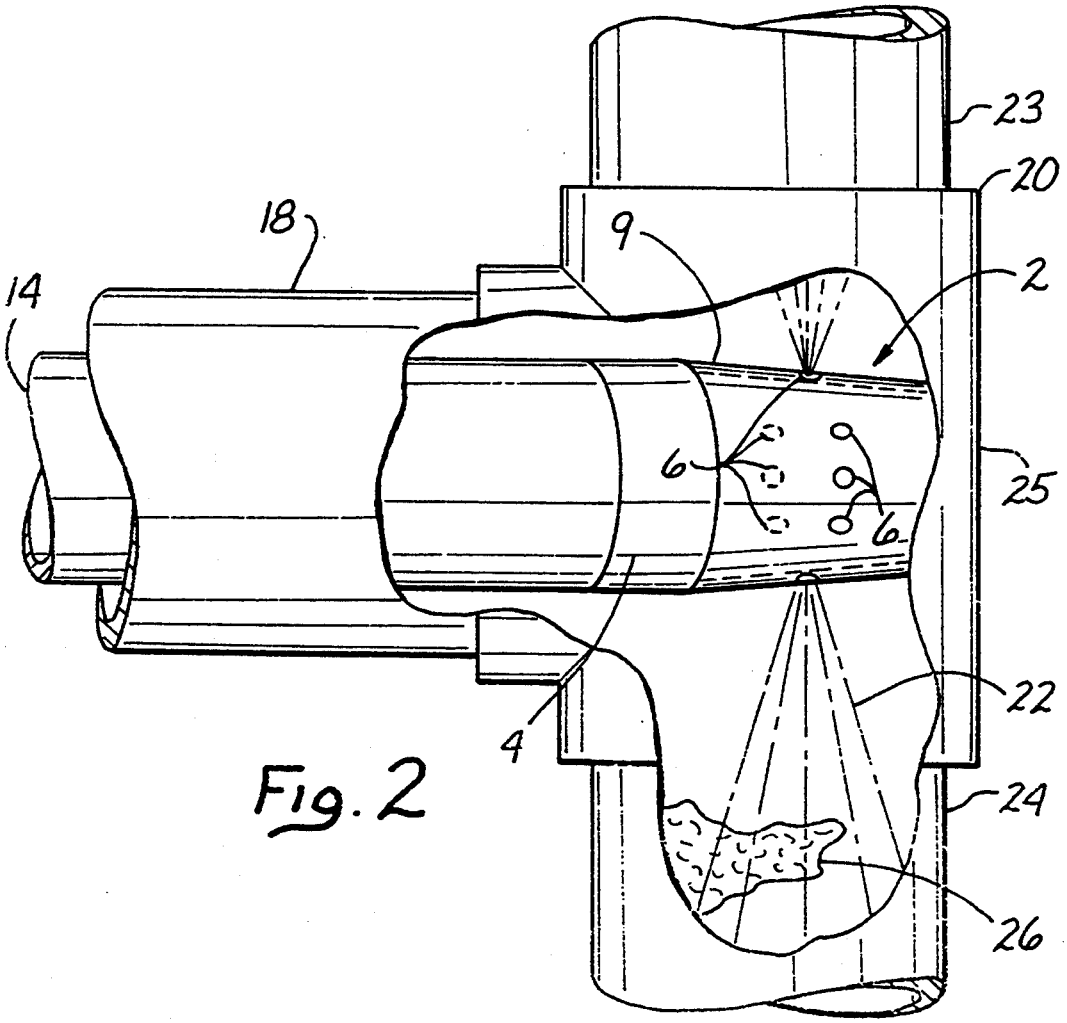
FIG. 2 is a somewhat schematic side elevation view of a lateral right angle T-joint coupling of three segments of drain pipe with parts broken away to more clearly show the positioning and operation of a nozzle in accordance with the present invention.

FIGS. 1 and 2 show a nozzle 2 made of rigid material, for example, metal or polymeric material, with a maximum outside diameter at threaded end portion 4 smaller than the inside diameter of the drain pipe 18 (shown in FIG. 2). When the threaded end portion 4 of nozzle 2 is connected to a garden water hose 14, the nozzle can freely move through the longitudinal drain pipe 18 to the remote and unseen stop position located in the right angle T-joint coupling 20 secured to the longitudinal drain pipe conduit. Eight (8) lateral, equally spaced apart peripheral through holes 6 are positioned in circular cylindrical peripheral sidewall 9. Each of the peripheral through holes 6 is positioned or oriented in sidewall 9 so that fluid passing from interior space 17 flows out of the peripheral through hole in a direction substantially perpendicular to longitudinal axis 11. All of the peripheral through holes 6 pass through a single plane which is substantially perpendicular to the longitudinal axis 11 of nozzle 2.

In addition, nozzle 2 includes a distal end wall 15 through which a longitudinal through hole 8 is passed.

Each of the peripheral through holes 6 is positioned and oriented so that high pressure fluid from the interior space 17 defined by peripheral sidewall 9 and distal end wall 15 passes through peripheral through holes 6 in a direction substantially perpendicular to the longitudinal axis 11 of nozzle 2. Also, the longitudinal through hole 8 is positioned so that high pressure fluid passing from interior space 17 through the longitudinal through hole will flow in a direction through the longitudinal axis 11 of nozzle 2.

An additional feature of the present invention is that the plane through which all of the peripheral through holes 6 pass is located a distance from the distal-most point of distal end wall 15 equal to about one-half of the diameter of the right angle drain pipe segments 23 and 24 which are coupled to couple 20. This feature allows or provides for an automatic positioning effect of the nozzle 2 so that high pressure fluid is passed directly into the middle of drain pipe extensions 23 and 24, as shown in FIG. 2.

To illustrate, the nozzle 2, threadedly connected, using threads 27 on end portion 4, to water hose 14 is passed through longitudinal drain pipe 18 until it abuts against the end wall 25 of T-joint 20, again as shown in FIG. 2. At this point, the peripheral through holes 6 are located substantially in the middle of the passage way of drain pipe extensions 23 and 24. When high pressure fluid is passed from hose 14 into interior space 17 and through peripheral through holes 6, the high pressure fluid flows directly into drain pipe segments 23 and 24 so as to provide the maximum cleaning effect. Thus, not only is high pressure fluid provided but also, because of the configuration of the present nozzle 2, direct flow into the drain pipe segments 23 and 24, one or both of which is clogged with solid or semi-solid debris, is facilitated, thus providing for effective debris cleaning.

In addition, high pressure fluid from interior space 17 can be passed through longitudinal through hole 8 as the nozzle 2 is being passed into position through drain pipe 18. In this manner, any debris in longitudinal drain pipe 18 can be removed so as to facilitate positioning nozzle 2, as shown in FIG. 2. Once nozzle 2 is placed in its final position, as shown in FIG. 2, high pressure fluid can be passed through peripheral through holes 6 so that a portion of this high pressure fluid passes directly as a flow of liquid, shown at 22 in FIG. 2, into drain pipe segment 24 to effectively clear clogging debris 26. The flow of liquid 22 (as well as all of the remainder of the fluid passing from interior space 17 though peripheral through holes 6 flows in a direction substantially perpendicular to the longitudinal axis 11 of nozzle 2.

After the debris has been removed, nozzle 2 can be very easily removed by passing it proximally back in drain pipe 18. Nozzle 2 can then be unthreaded from hose 14 and stored, ready for use when next needed.

While this invention has been described with respect to various specific examples and embodiments, it is to be understood that the invention is not limited thereto and that it can be variously practiced within the scope of the following claims.

What is claimed is:

1. A combination comprising:

a conduit including a longitudinal segment and at least one other segment positioned perpendicular to said longitudinal segment;

a nozzle body having a longitudinal axis and defining an interior space adapted to be placed in fluid communication with a source of high pressure [fluid-]aqueous-based liquid, said nozzle body being sized and adapted to pass freely through said longitudinal segment;

said nozzle body including a peripheral sidewall having a plurality of spaced apart peripheral through holes positioned and adapted to cause high pressure aqueous-based liquid from said interior space to pass through said peripheral through holes into said conduit in a direction perpendicular to said longitudinal axis; and said nozzle body including a distal end wall having at least one longitudinal through hole positioned and adapted to cause high pressure aqueous-based liquid from said interior space to flow through said longitudinal through hole into said conduit in a direction parallel to said longitudinal axis.

2. The combination of claim 1 wherein said peripheral sidewall is structured to provide for attachment of said nozzle body to the source of high pressure aqueous-based fluid.

3. The combination of claim 1 wherein said peripheral sidewall is threaded to provide for attachment of said nozzle body to the source of high pressure aqueous-based fluid.

4. The combination of claim 1 wherein said peripheral through holes are equally spaced around the periphery of said nozzle body and all pass through a single plane perpendicular to the longitudinal axis of the nozzle body, said at least one segment has a diameter and said plane is located a distance away from said distal end wall equal to about one-half of said diameter.

5. The combination of claim 1 wherein said peripheral through holes all pass through a single plane perpendicular to the longitudinal axis of said nozzle body.

6. The combination of claim 1 wherein said longitudinal through hole passes through the longitudinal axis of said nozzle body.

7. The combination of claim 1 wherein said at least one other segment positioned perpendicular to said longitudinal segment is a sewer drain pipe, and said nozzle body has about 4 to about 10 of said peripheral through holes.

8. The combination of claim 1 wherein said nozzle body has about 8 of said peripheral through holes.

9. A method of passing high pressure aqueous-based liquid to at least one segment of drain pipe positioned perpendicular to a conduit, said method comprising:

passing a nozzle in fluid communication with a source of high pressure aqueous-based liquid through said conduit, said nozzle defining an interior space, having a longitudinal axis, and including a distal end wall and a peripheral sidewall with a plurality of spaced apart peripheral through holes positioned to allow high pressure aqueous-based liquid from said interior space to pass through said peripheral through holes in a direction perpendicular to said longitudinal axis, said passing being conducted so as to position said nozzle relative to said at least one segment of drain pipe positioned perpendicular to said conduit so that high pressure aqueous-based liquid from said interior space flows directly from at least one of said peripheral through holes into said at least one segment of drain pipe positioned perpendicular to said conduit; and causing high pressure aqueous-based liquid to flow from the source of high pressure aqueous-based liquid into said interior space, through said peripheral through holes and directly into said at least one segment of drain pipe positioned perpendicular to said conduit.

10. The method of claim 9 wherein both said conduit and said at least one segment of drain pipe positioned perpendicular to said conduit are portions of the same drain system.

11. The method of claim 9 wherein said at least one segment of drain pipe positioned perpendicular to said conduit, prior to said causing step, is at least partially blocked with debris, and said causing step is conducted for a time sufficient to remove at least a portion of said debris from said at least one segment of drain pipe positioned perpendicular to said conduit.

12. The method of claim 9 wherein said nozzle has a sufficiently small maximum cross-sectional area perpendicular to the longitudinal axis of said nozzle to pass freely through said conduit and into said position.

13. The method of claim 9 wherein said distal end wall has at least one longitudinal through hole to cause high pressure aqueous-based liquid from said interior space to pass through said longitudinal through hole in a direction parallel to said longitudinal axis, and said method further comprises causing high pressure aqueous-based liquid to flow from the source of high pressure aqueous-based liquid into said interior space and through said longitudinal through hole.

14. The method of claim 9 wherein said peripheral through holes are equally spaced around the peripheral sidewall of said nozzle.

15. The method of claim 9 wherein said peripheral through holes all pass through a single plane perpendicular to the longitudinal axis of said nozzle, and said plane is located a distance away from said distal end wall equal to about one-half the diameter of said at least one segment of drain pipe positioned perpendicular to said conduit.

16. The method of claim 9 wherein said nozzle body has about 4 to about 10 of said peripheral through holes.

17. The method of claim 13 wherein said longitudinal through hole passes through said longitudinal axis.

18. The method of claim 9 wherein said drain pipe is a sewer drain pipe.

* * * * *

UNITED STATES PATENT AND TRADEMARK OFFICE

CERTIFICATE OF CORRECTION

PATENT NO. : 5,421,904

DATED : June 6, 1995

INVENTOR(S) : Carlson

It is certified that error appears in the above-indentified patent and that said Letters Patent is hereby corrected as shown below:

Column 4, lines 34 and 35; delete the word "fluid".

Column 4, claim 2, line 54 and claim 3, line 58; delete "fluid" and insert in place thereof --liquid--.

Signed and Sealed this

Seventeenth Day of September, 1996

Bruce Lehman

*Attest:*

BRUCE LEHMAN

*Attesting Officer*

*Commissioner of Patents and Trademarks*